United States Patent [19]

Sofy

[11] Patent Number: 4,884,363

[45] Date of Patent: Dec. 5, 1989

[54] TREE STAND

[76] Inventor: Hugh M. Sofy, 201 Warrington, Bloomfield Hills, Mich. 48013

[21] Appl. No.: 281,921

[22] Filed: Dec. 5, 1988

Related U.S. Application Data

[63] Continuation of Ser. No. 107,546, Oct. 13, 1987, abandoned.

[51] Int. Cl.[4] ..... A47G 33/12

[52] U.S. Cl. ..... 47/40.5; 248/527

[58] Field of Search ..... 47/40.5, 39; 248/523, 248/524, 527, DIG. 10

[56] References Cited

U.S. PATENT DOCUMENTS

| | | | |
|---|---|---|---|
| 1,551,093 | 8/1925 | Fletcher | 248/527 |
| 2,493,633 | 1/1950 | Mart | 206/519 |
| 2,905,414 | 9/1959 | Zierden | 47/40.5 |
| 2,915,620 | 12/1959 | Robinson | 248/524 |
| 2,980,377 | 4/1961 | Nielsen et al. | 47/40.5 |
| 4,571,881 | 2/1986 | Lathim | 47/40.5 |
| 4,596,262 | 6/1986 | Tegzi | 47/40.5 |
| 4,726,553 | 2/1988 | Wischusen | 220/85 H |

FOREIGN PATENT DOCUMENTS

| | | | |
|---|---|---|---|
| 6410477 | 3/1965 | Netherlands | 47/39 |

*Primary Examiner*—Danton D. DeMille

*Attorney, Agent, or Firm*—Reising, Ethington, Barnard, Perry & Milton

[57] ABSTRACT

A tree stand (10) comprises a cup-shaped receptacle (12) including an upwardly extending peripheral wall (18), a skirt (20) disposed about the exterior of the receptacle (12), and a base (14) extending outwardly from the skirt (20). The angle between the peripheral wall (18) and the skirt (20) is relatively small so that the bolts (24) extending through the skirt (20) and the receptacle (12) can be arranged in vertically spaced pairs.

11 Claims, 5 Drawing Sheets

TREE STAND

This application is a continuation of application Ser. No. 107,546, filed Oct. 13, 1987now abandoned.

TECHNICAL FIELD

The subject invention relates to a device for vertically supporting a tree, and further relates to a device providing a potted plant receptacle.

BACKGROUND ART

Tree stands are commonly used for supporting trees, e.g., Christmas trees, in a vertically upright manner. Such tree stands usually include a receptacle for receiving the base, or trunk, of a tree along with a volume of water, and bracing means, e.g., thumb screw, straps, etc., for propping the tree in a vertically upright posture. The water contained in the receptacle surrounds the tree base and provides nourishment to the tree thereby prolonging its live appearance.

Examples of tree support devices are disclosed in the U.S. Pats. 2,421,140 to Blaner and 2,855,168 to Vigna. These prior art patents disclose receptacles adapted to receive the base of a tree and a volume of liquid, bolts threadable through the receptacle for pressing against the tree base, and detachable legs. These tree stand devices are deficient in that they require many individually manufactured parts, and are not well suited for compact storage with like parts, such as by nesting within one another.

Examples of one-piece tree support devices adapted for compact storage with like devices, such as by nesting within one another, are shown in the U.S. Pat. 4,126,963 to Dunbar, and the "Con-i-Stand", manufactured by Olympic Specialties Company, Portand, Oreg.. However, the Dunbar '963 tree stand is deficient in that it requires the boring of a frustoconical hole in the base of the tree for support on a peg. If the tree has a crooked trunk, the peg will not prop it in a vertically upright posture. Additionally, no provision for bracing the tree upright with bolt means, e.g., thumb screws, is made. Thus, a large tree can not be properly stabilized. The "Con-i-Stand", by Olympic Specialties Co., is deficient in that the outer wall, or skirt, which extends from the top of the tree receptacle to the ground support, projects outwardly and downwardly from the receptacle at an excessively large angle. The purpose for the outer wall projecting outwardly at a very large angle is to provide adequate support for the device. However, this results in the inability to use vertically spaced pairs of bolt means, i.e., upper and lower pairs of bolts, to press against the tree base since the distance between the outer wall and the receptacle increases significantly as one moves down the receptacle. In other words, it would be impractical to use vertically spaced pairs of bolt means on the "Con-i-Stand" since extremely long bolts would be required to span the distance between the outer wall and the receptacle at positions spaced below the upper edge of the receptacle.

SUMMARY OF THE INVENTION AND ADVANTAGES

A tree stand device of the subject invention is adapted to support a tree in a vertically upright position. The tree stand includes a receptacle for receiving the base of a tree and a volume of liquid. The receptacle has an upwardly extending peripheral wall. The tree stand also includes a skirt which extends outwardly and downwardly from the exterior of the peripheral wall. Bolt means are provided which extend inwardly through the skirt and the peripheral wall of the receptacle for releasably engaging the tree. The tree stand is characterized by the angle between the peripheral wall and the skirt being relatively small, and by including a base means which extends outwardly and downwardly from the skirt, having a greater frustum slope than the skirt for providing a large area of support for the device.

The subject tree stand is advantageous over the prior art tree stands by providing a skirt which extends outwardly and downwardly from the peripheral wall at a small angle so that the distance between the skirt and the peripheral wall does not increase substantially as one goes down the receptacle, and by providing a base which extends outwardly and downwardly at a large frustum angle to create a large area of support for the device. The narrow distance between the peripheral wall and the skirt is advantageous when vertically spaced pairs of bolt means extend into the receptacle, so that the lowermost bolt means do not have to be of great length to span the distance. The use of upper and lower bolt means, i.e., vertically spaced pairs, is particularly useful when the tree base, or trunk, is crooked, thereby allowing for multipoint contact along the height of the tree base.

Additionally, the subject tree stand is constructed for allowing like parts to be stacked and nested within one another for compact storage. Further, the subject tree stand can be modified to receive small potted plants or provide a horizontal support surface when not utilized as a tree stand.

FIGURES IN THE DRAWING

Other advantages of the present invention will be readily appreciated as the same becomes better understood by reference to the following detailed description when considered in connection with the accompanying drawings wherein:

FIG. 4 is a front view of the subject invention including an insert means for receiving potted plants and the like;

DESCRIPTION OF THE PREFERRED EMBODIMENT OF FIGS. 1-3 AND 6

Figure 2:
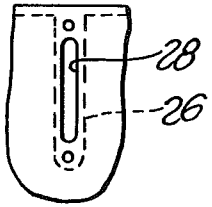
FIG. 2 is a fragmentary side view, slightly enlarged, of the subject invention taken along line 2—2 of FIG. 1.

The embodiment illustrated in FIGS. 1 through 3 and 6, is particularly suited for use as a tree stand device.

Referring to the figures, wherein like numerals indicate like or corresponding parts throughout the several views, the subject tree stand is generally shown at 10. The tree stand 10 is symmetrical about a vertical axis A, and includes a receptacle, generally indicated at 12, for receiving a tree and a volume of liquid. The base, or trunk, of a tree is shown in phantom at 13 in FIG. 3.

In the preferred embodiment, the tree stand 10 is a body of revolution about the vertical axis A. The receptacle 12 is cup-shaped for containing the liquid, e.g., water, and for surrounding the base 13 of a tree disposed therein so that the tree is supported above a base support, e.g., the floor, a table, etc., in an upright posture. The receptacle 12 comprises a disk-like bottom end 16 and a peripheral wall is extendedly upwardly from the bottom end 16. This is to say, the wall 18 and bottom end 16 define the receptacle 12 in a cup-shape.

A skirt 20 extends outwardly and downwardly about the exterior of the peripheral wall 18 for supporting a base means, generally indicated at 14. An annular connecting portion 21 is disposed at the uppermost edge of the peripheral wall 18, and extends between the receptacle 12 and skirt 20 to connect the two together. In other words, the skirt 20 is disposed between the connecting portion 21 and the base means 14.

The base means 14 extends outwardly and downwardly from the skirt 20, and has a greater outward projection than the skirt 20 for providing a large area of support to the device 10. Said another way, the outward slope of the base means 14, relative to the vertical axis A, is significantly greater than the frustum slope of the skirt 20. In the preferred embodiment wherein the tree stand 10 is a body of revolution, the base means 14 has a frustum slope and extends radially outwardly from the vertical axis A a substantial distance, thereby providing a high resistance to overturning, or tipping. This defiance to tipage is particularly advantageous when a tall tree is supported in the tree stand 10, whereby the tree would otherwise create a great amount of leverage with which to overturn the tree stand 10.

Figure 3:
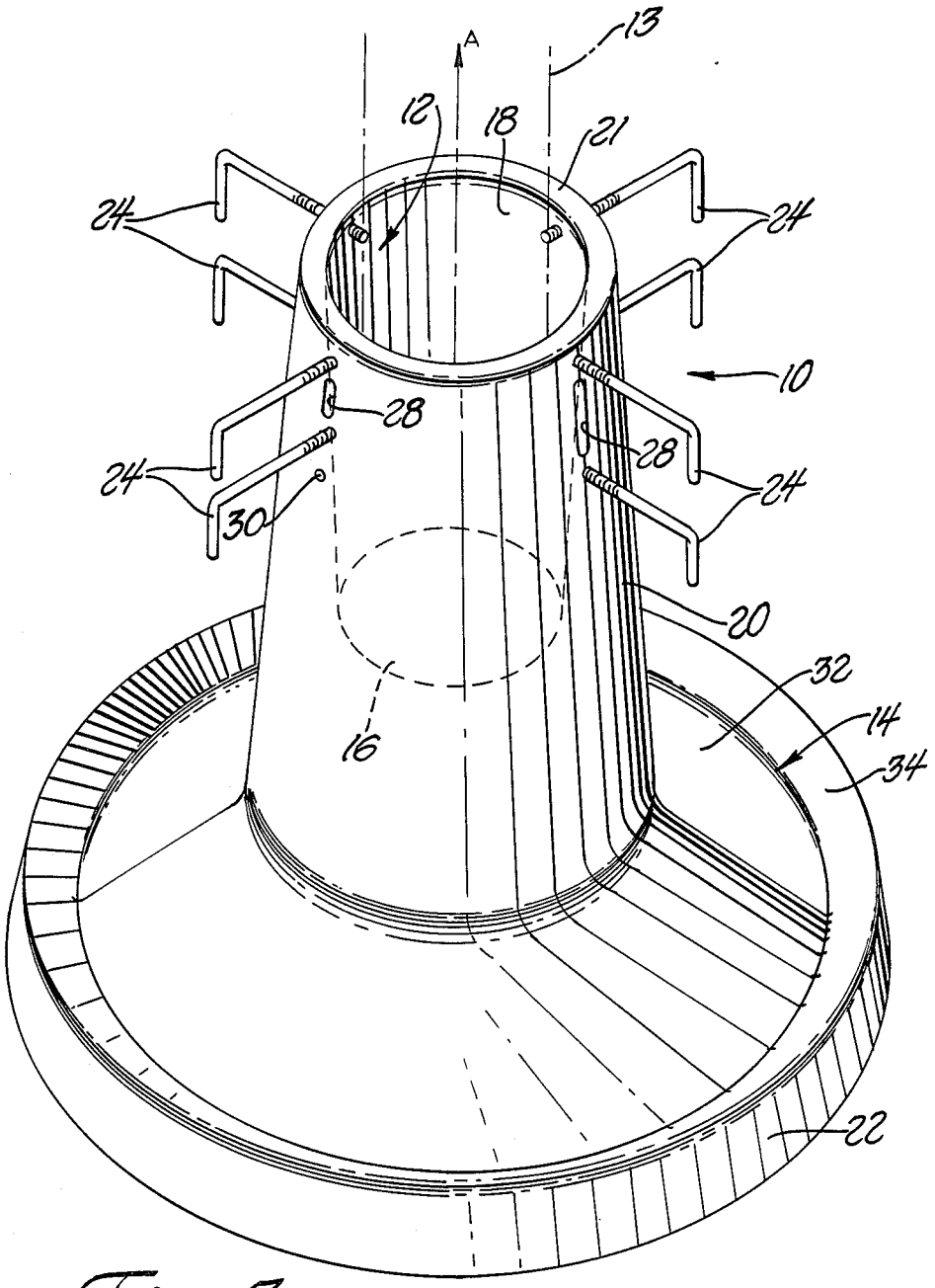
FIG. 3 is a perspective view of the subject invention.

The tree stand 10 includes bolt means 24 extending inwardly through the skirt 20 and peripheral wall 18 of the receptacle 12 for releasably engaging the tree 13. Preferably, the bolt means 24 comprise four pairs of vertically spaced bolts arranged in equal radial increments about the receptacle 12. In other words, eight bolt means 24 are disposed in 90° increments about the receptacle 12 in pairs of vertically spaced upper and lower threaded bolts. As shown in FIG. 3, the bolt means 24 may be L-shaped to better allow an individual to grip and twist the bolt means 24 through the receptacle 12 and press against the tree 13.

The angle between the peripheral wall 18 and the skirt 20 is relatively small, so that the distance between the two remains substantially the same. In other words, the narrow angle between the peripheral wall 18 and skirt 20 insures that the skirt 20 does not diverge from the peripheral wall 18 a significant distance. This is of particular concern when vertically spaced pairs of bolt means 24 extend through the skirt 20 and the peripheral wall 18, so that the lowermost bolt means 24 do not have to be of great length to span the distance between the skirt 20 and peripheral wall 18.

The base means 14 may adjoin the skirt 20 at any location below the lowermost bolt means 24, so as not to defeat the purpose of the narrowly spaced skirt 20 and peripheral wall 18. In this manner, the overall height of the tree stand 10 may be varied by altering the skirt 20 height, or base means 14 height or frustum slope.

As shown in the drawing figures, the receptacle 12, skirt 20, and the base means 14 are of a one-piece integral construction, and the tree stand 10 takes the form of a body of revolution about the vertical axis A. Preferably, the tree stand 10 is manufactured from an injection molded plastic material. Such a plastic construction may include a plurality of ejector pin pads 36 strategically located for assisting in the removal of an injection molded plastic tree stand 10 from the mold.

Figure 6:
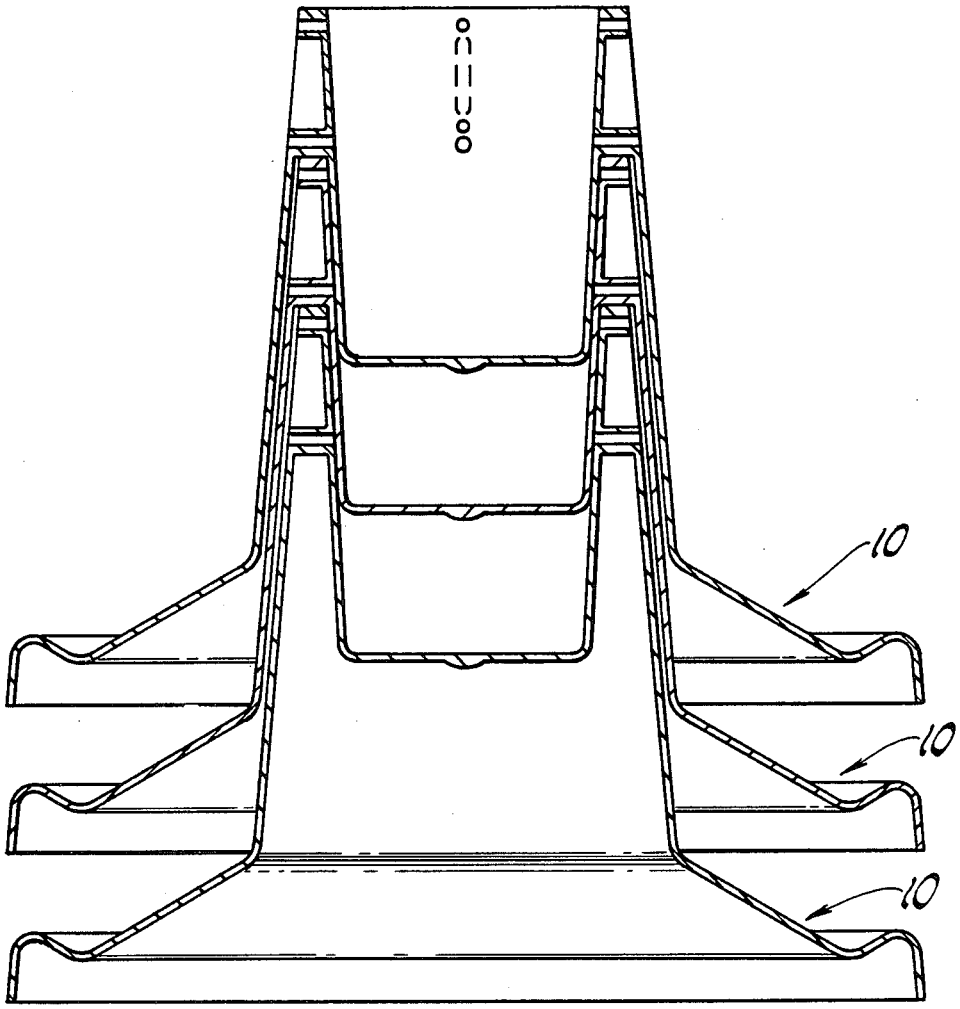
FIG. 6 is a cross-sectional view of three individual tree stands of the subject invention vertically stacked and nested for compact storage.

As perhaps best shown in FIG. 3, the peripheral wall 18 of the receptacle 12 has an inverted frustum shape for allowing one tree stand 10 to nest within another. The frustum shape of the skirt 20 and the inverted frustum shape of the receptacle 12 enable one tree stand 10 to nest within another in a vertically stacked orientation, as shown in FIG. 6. The nesting of like devices is particularly advantageous in the storing and transportation of mass quantities of tree stands, as valuable space can be conserved.

The base means 14 comprises a first surface 32 which extends from the periphery of the skirt 20, a second surface 34 having an inverted frustum shape, i.e., extending outwardly and upwardly from the radially outward edge of the first surface 32, and a leg 22 which extends outwardly and downwardly from the radial outward edge of the second surface 34 to define and annular trough. The annular trough is specifically adapted for capturing overflow liquid from the receptacle 12, thereby preventing leakage of the liquid onto the base support, which would otherwise soil the base support and possibly cause damage. The leg 22 provides a contact with the base support at an extreme radial displacement from the central axis A, thereby furnishing a high resistance to tipage. The frustum shape of the first surface 32, inverted frustum shape of the second surface 34, and frustum shape of a leg 22 may further cooperate with the nesting of one tree stand 10 within another, if so desired.

Figure 1:
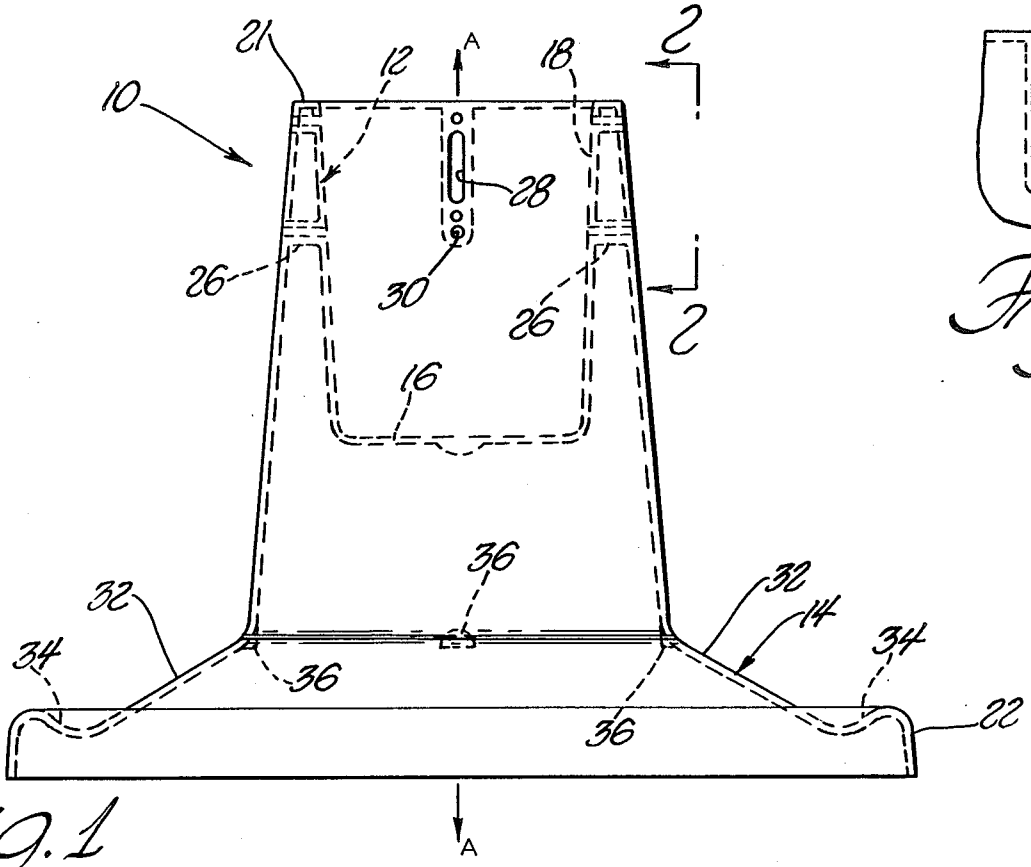
FIG. 1 is a front view of the subject invention.

The tree stand 10 includes a web 26 extending between the peripheral wall 18 of the receptacle 12 and the skirt 20 and surrounding each pair of vertically spaced bolt means 24 for reinforcing the bolt means 24 extending therethrough. As best shown in FIGS. 1 and 2, four webs 24 are disposed about the receptacle 12 in equally spaced radial increments, i.e., 90° increments, to reinforce two vertically spaced bolt means 24. Said another way, each web 26 extends between and supports the pair of two vertically spaced bolt means 24, the uppermost bolt means 24 being disposed near the uppermost edge of the receptacle 12 and the lowermost bolt means 24 spaced vertically below the first bolt means 24.

The webs 26 each include a vertically elongated cavity 28 disposed between each pair of vertically spaced bolt means 24 and extending radially outwardly from adjacent the exterior surface of the peripheral wall 18 through the exterior surface of the skirt 20. Stated another way, the cavities 28, as perhaps best shown in FIGS. 2 and 3, are disposed through the skirt 20 and extend up to but not through the peripheral wall 18 and the receptacle 12. The purpose of the cavity 28 is to prevent needless waste of web 24 material since only the portion of web 26 surrounding the bolt means 24 is needed to effectively provide reinforcement.

The web 26 includes a drain passage 30 extending from the interior of the receptacle 12 to the exterior of the skirt 20 for allowing the passage of liquid therethrough. The drain passage 30 is disposed through the skirt 20 and receptacle 12 at a predetermined height to meter the volume of liquid contained in the receptacle 12. In this manner, water, or other suitable liquid, is poured into the receptacle 12 until an amount of the water can be observed exiting the receptacle 12 through the drain passage 30. As the liquid exits the receptacle 12 through the drain passage 30, it trickles down the exterior surface of the skirt 20 and into the annular trough where it is captured, thereby preventing leakage onto the base support. The drain passage 30 prevents the receptacle 12 from being severally over filled.

In the preferred embodiment which includes four webs 26, only one drain passage 30 is required, and it is positioned in the bottommost portion of the web 26, or where the lowermost bolt means 24 would be otherwise located. Accordingly, in the one web 26 which includes the drain passage 30, the lowermost bolt means 24 is positioned directly above the drain passage 30, thereby diminishing the distance between the two bolt means 24 extending through the one web 26, as shown in FIGS. 1 and 3.

A tree, such as a Christmas tree, is vertically supported in the subject tree stand 10 by positioning the base 13 of the tree in the receptacle 12 so that the bottom of the tree rests on the receptacle bottom end 16, or the lowermost branches rest on the annular connecting portion 21. The bolt means 24 are then individually turned into pressing engagement with the base 13 of the tree to vertically prop the tree in an upright posture. Should the tree base 13 be crooked or non-uniform in some manner, the vertically spaced pairs of bolt means 24 are individually adjusted to engage the base 13 of the tree in multiple, vertically spaced locations for ensuring that the tree is propped in a vertically upright posture.

The tree stand 10 is particularly well adapted for mass storage by vertically stacking one tree stand 10 upon another such that the like devices compactly nest together, as best shown in FIG. 6. As will be appreciated, the bolt means 24 must be removed prior to stacking. The amount of distance between stacked tree stands 10 is dependant upon such variables as web 26 length, receptacle 12 and skirt 20 frustum slope, leg 22 length, etc. In the preferred embodiment, the bottom of the web portions 26 of a nested tree stand 10 rest on the annular connecting portion 21 of a lower tree stand 10. In this manner, a space is provided between the inner and outer surfaces of the adjacent skirts 20 which facilitate separating nested tree stands 10. That is to say, the annular connecting portion 21 is adapted to support another like tree stand 10 when in a nested relationship, to allow a space to exist between the adjacent skirts 20. This prevents either a suction buildup or a friction force fit from making separation difficult.

ALTERNATIVE EMBODIMENT OF FIGURES 4 AND 5

Figure 4:
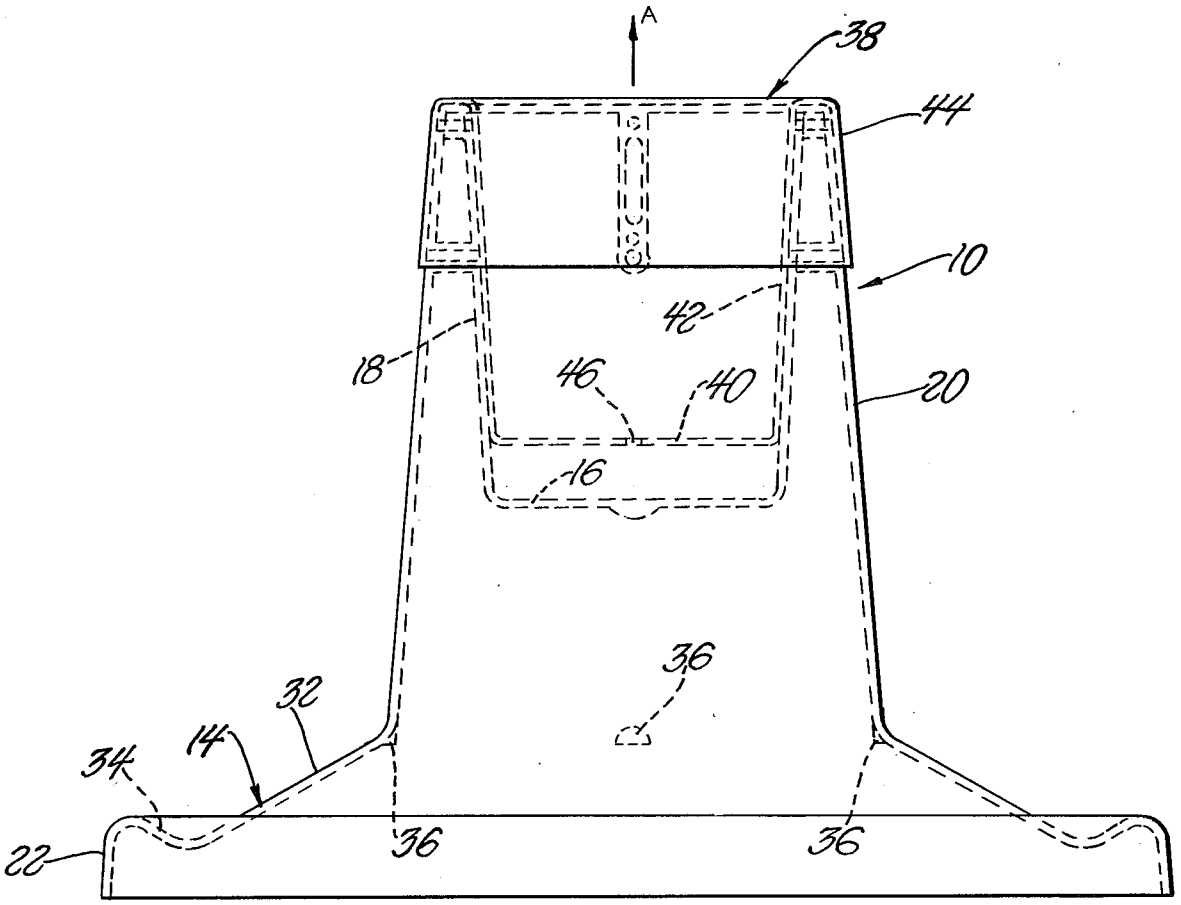
Figure 5:
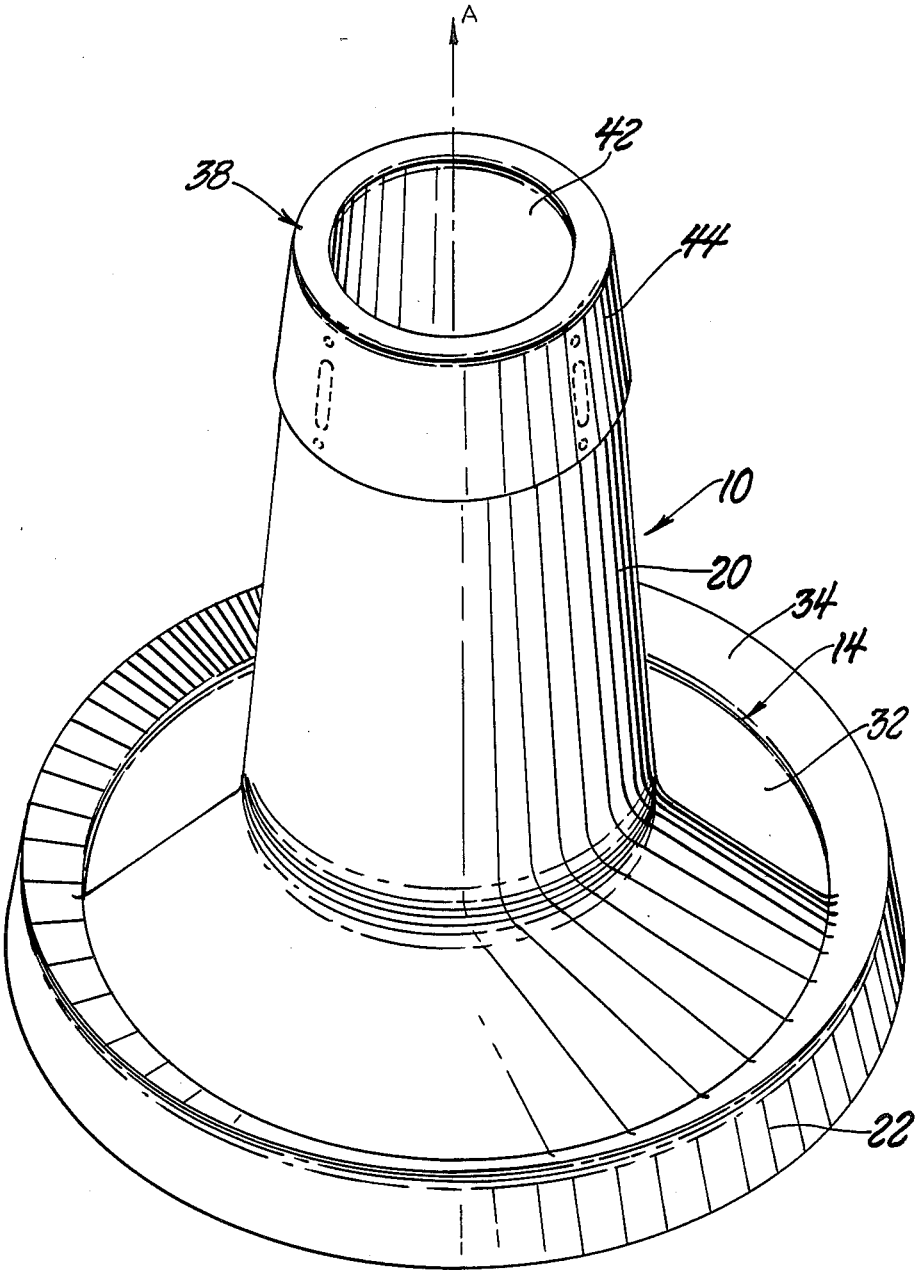
FIG. 5 is a perspective view of the subject invention including the insert means shown in FIG. 4.

Referring now to FIGS. 4 and 5, an alternative embodiment of the tree stand 10 comprises an insert means, generally indicated at 38, adapted to be received into and supported by the receptacle 12 for diminishing the internal volume of the receptacle 12. The insert means 38 is particularly useful for receiving and displaying small plants and the like. The insert means 38 includes a disc-like bottom plate 40, an inverted frustum shaped partition 42 extending upwardly from the bottom plate 40, and a frustum shape lip 44 extending downwardly from the upper end of the partition 42 about the exterior of the skirt 20. Preferably, the lip 44 extends over the drain passage 30 and all of the threaded passages reserved for the bolt means 24, thereby hiding them from view. As will be appreciated, the bolt means 24 must be removed prior to positioning the insert means in the receptacle 12. At least one drain hole 46 is disposed centrally in the bottom plate 40 for allowing the passage of liquid therethrough.

As shown in FIG. 4, the frustum slope of the partition 42 is substantially equal to the frustum slope of the peripheral wall 18, i.e., they are parallel when stacked. Likewise, the frustum slope of the lip 44 is substantially equal to the frustum slope of the skirt 20. The corresponding slopes between the partition 42 and the peripheral wall 18, and between the lip 44 and skirt 20 are provided with a slight clearance therebetween when in the inserted portion so that they are easily separated, and also for eliminating the need to fasten the insert means 38 to the tree stand 10.

Whenever the tree stand 10 is not used to support a tree, the insert means 38 can be inserted into the receptacle 12 for such use as a flower pot, or the like. Such use would comprise filling the insert means 38 with an appropriate volume of potting soil, sewing the appropriate seed or mature plant, and adding an appropriate supply of water to ensure growth. Excess water in the potting soil will flow by gravitation through the drain hole 46 and be captured in the receptacle 12. As will be appreciated, more than one drain hole 46 may be utilized to achieve the same result. Preferably, the insert means 38 is of a one-piece integral construction. The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A tree stand device for supporting a tree in an upright posture, said device (10) comprising; a receptacle (12) including an upwardly extending peripheral wall (18), an axis (A) extending centrally through said receptacle (12), a skirt (20) extending outwardly and downwardly about the exterior of said peripheral wall (18) at a first predetermined acute angle relative to said axis (A), said device (10) characterized by including a base means (14) extending outwardly and downwardly from said skirt (20) at a second predetermined acute angle relative to said axis (A) which is larger than said first angle for providing a large area of support to said device (10), a plurality of bolts (24) extending inwardly through said skirt (20) and said peripheral wall (18) of said receptacle (12) and disposed circumferentially about said receptacle (12) with at least two of said bolts (24) being spaced axially from one another, and support webs (26) associated with and surrounding each of said bolts (24) disposed between said peripheral wall (18) and said skirt (20).

2. A device (10) as set forth in claim 1 further characterized by said receptacle (12), said skirt (20), and said base means (14) being of a one-piece integral construction.

3. A device (10) as set forth in either of claims 1 or 2 further characterized by said peripheral wall (18) of said receptacle (12) having an inverted frustum shape for allowing one said device (10) to nest within another.

4. A device (10) as set forth in claim 3 further characterized by said base means (14) comprising a first surface (32) extending from the periphery of said skirt (20), a second surface (34) having an inverted frustum shape extending outwardly and upwardly from the radially outward edge of said first surface (32), and a leg (22) extending outwardly and downwardly from the radially outward edge of said second surface (34), said first surface (32) and said second surface (34) defining an annular trough.

5. A device (10) as set forth in claim 4 further characterized by said webs (26) each including an axially elongated cavity (28) extending radially outwardly from adjacent the exterior surface of said peripheral wall (18) to the exterior surface of said skirt (20).

6. A device (10) as set forth in claim 5 further characterized by said web (26) including a drain passage (30) extending from the interior of said receptacle (12) to the exterior of said skirt (20) for allowing the passage of liquid therethrough.

7. A device (10) as set forth in claim 4 further characterized by including an annular connecting portion (21) extending between said receptacle (12) and said skirt (20), said annular connecting portion (21) adapted to support another like device (10) when positioned in a nested relationship.

8. A device (10) as set forth in claim 3 further characterized by including an insert means (38) adapted to be received into and supported by said receptacle (12) for diminishing the internal volume of said receptacle (12).

9. A device (10) as set forth in claim 8 further characterized by said insert means (38) including a disc-like bottom plate (40), an inverted frustum shaped partition (42) extending upwardly from said bottom plate (40), and a frustum shaped lip (44) extending downwardly from the upper end of said partition (42) about the exterior of said skirt (20).

10. A device as set forth in claim 9 further characterized by said bottom plate (40) including at least one drain hole (46) disposed therethrough.

11. A tree stand device (10) for supporting a tree in an upright posture, said device (10) comprising; a receptacle (12) including an inverted frustum shaped peripheral wall (18), an axis (A) extending centrally through said receptacle (12), an annular connecting portion (21) extending radially outwardly from the uppermost edge of said peripheral wall (18), a frustum shaped skirt (20) extending downwardly from said annular connecting portion (21) at a first predetermined acute angle relative to said axis (A), a base (14) having a frustum shaped first surface (32) extending from the periphery of said skirt (20) at a second predetermined acute angle relative to said axis (A) which is larger than said first angle and an inverted frustum shaped second surface (34) extending from the radially outward edge of said first surface (32) and a frustum shaped leg (22) extending from said second surface (32), four pairs of bolts (24) arranged in equal radial increments about said receptacle (12) disposed through said skirt (20) and said receptacle (12), each pair of said four pairs of bolts (24) being arranged in an axially spaced relationship, four support webs (26) extending between said peripheral wall (18) and said skirt (20), each of said support webs (26) surrounding one of said pair of bolts (24), and said receptacle (12), said skirt (20), and said base (14) being a one-piece integral body.

* * * * *